US005427008A

United States Patent [19]

Ueba et al.

[11] Patent Number: 5,427,008

[45] Date of Patent: Jun. 27, 1995

[54] CORE MATERIAL OF STRING FOR INSTRUMENTS AND STRING FOR INSTRUMENTS USING THE SAME

[75] Inventors: Hisaaki Ueba; Kazuaki Ohashi; Yosio Sunaga, all of Tochigi, Japan

[73] Assignee: Kureha Kagaku Kogyo Kabushiki Kaisha, Tokyo, Japan

[21] Appl. No.: 189,551

[22] Filed: Feb. 1, 1994

[30] Foreign Application Priority Data

Feb. 12, 1993 [JP] Japan ..... 5-047451

[51] Int. Cl.[6] ..... G10D 3/00

[52] U.S. Cl. ..... 84/297 S; 84/199; 428/364

[58] Field of Search ..... 84/297 R, 297 S, 199; 428/374, 394, 364

[56] References Cited

U.S. PATENT DOCUMENTS 4,382,358 5/1983 Tappe et al. ..... 428/394 X
4,833,027 5/1989 Ueba et al. ..... 428/364

FOREIGN PATENT DOCUMENTS 63-11996 1/1988 Japan .

*Primary Examiner*—M. L. Gellner
*Assistant Examiner*—Patrick J. Stanzione
*Attorney, Agent, or Firm*—Nixon & Vanderhye

[57] ABSTRACT

Core materials for strings for musical instruments of a twist of two or more multifilaments composed of a vinylidene fluoride resin. The multifilament core has a diameter of 0.1 to 5 mm, an elongation of 10 to 50%, a tensile strength of at least 30 kg/mm$^2$, a creep elongation of at most 15% and a Young's modulus of at least 200 kg/mm$^2$. The multifilament is made of monofilaments each having a diameter of 1 to 300 $\mu$m, a dispersion diameter of at most 20%/m, a specific gravity of at least 1.6, an inherent viscosity of 0.85 to 1.6 dl/g, an apparent viscosity of 12,000 to 100,000 poise and a birefringence of $30\times10^{-3}$. Strings for violins, cellos and the like are made by tightly wrapping the core with a metal string.

8 Claims, 1 Drawing Sheet

CORE MATERIAL OF STRING FOR INSTRUMENTS AND STRING FOR INSTRUMENTS USING THE SAME

BACKGROUND OF THE INVENTION

The present invention relates to a core material of a string for instruments and a string for instruments using the same. More particularly, the present invention relates to a core material of a string for instruments, which is composed of a vinylidene fluoride resin and which can produce an excellent effect when used for a lower-pitched string of a violin or other instruments, and also relates to a string for instruments using such a core material.

A string for instruments such as a violin is composed of a core material and a metal wire tightly wound around the core material. Strings for instruments known at present are classified into several kinds according to the core material, and a gut string and a nylon string are mainly used as a violin string.

A gut string which produces an excellent timbre, is disadvantageous in that it requires a long time for tuning, and in that since it is very sensitive to humidity, it is apt to become out of tune and is also easily broken. In addition, since the guts of animals are used as a material of a gut string, there is a problem from the point of view of the protection of natural sources and the prevention of cruelty to animals. Furthermore, not only is a gut string expensive but also there is a fear of a shortage of materials of a gut string.

On the other hand, a nylon string has the following defects. Since a nylon string has a water absorption property, a change of the material with the passage of time is rather large, so that the nylon string is apt to become out of tune with the elapse of time, and tuning is difficult. In addition, when a nylon string absorbs water, it is difficult to produce a clear sound. Furthermore, since the vibrational energy of a nylon string is small, the sound produced has a small volume and lacks a deep timbre, in other words, the sound is apt to be monotonous.

The present inventors proposed a string for instruments which is composed of a monofilament of a vinylidene fluoride resin (Japanese Patent Application Laid-Open (KOKAI) No. 2-36958 (1990)). It had been confirmed as a result of careful analysis of complicated timbres of strings for instruments that the above-described monofilament which simultaneously satisfies various properties described in the Japanese KOKAI, are excellent as a higher-pitched string of a guitar.

However, the string for instruments proposed in the above-described Japanese KOKAI is not originally intended for a violin and the like. It is difficult to produce a violin string by winding a metal wire around the string for instruments described in Japanese KOKAI because the metal wire slips during the winding process. Even if the metal wire is managed to be wound around the string, the timber produced from such a string is so unsatisfactory that the string cannot be used as a lower-pitched string of a violin nor a guitar.

As a result of various studies undertaken by the present inventors, it has been found that by twisting of multifilaments of a vinylidene fluoride resin, the obtained twist satisfying specific properties can produce an excellent effect when used for a violin string and is useful for a lower-pitched string of a violin or a guitar. The present invention has been achieved on the basis of this finding.

SUMMARY OF THE INVENTION

It is an object of the present invention to solve the above-described problems in the related art and to provide a core material of a string for instruments which can produce an excellent effect when used for a string of a violin or other instruments, and a string for instruments using such a core material.

To achieve the aim, in a first aspect of the present invention, there is provided a core material of a string for instruments comprising a twist of at least two multifilaments composed of a vinylidene fluoride resin, which simultaneously possesses the following properties (a) to (e):

(a) a diameter of 0.1 to 5 mm;
(b) an elongation of 10 to 50%;
(c) a tensile strength of not less than 30 kg/mm$^2$;
(d) a creep elongation of not more than 15% (measured 24 hours after a load under which the stress is 20% of the tensile strength is applied to the twist); and
(e) a Young's modulus of not less than 200 kg/mm$^2$.

In a second aspect of the present invention, there is provided a string for instruments comprising the core material as defined in the first aspect and a metal wire tightly wound around the core material.

DESCRIPTION OF THE PREFERRED EMBODIMENTS

Figure 1:
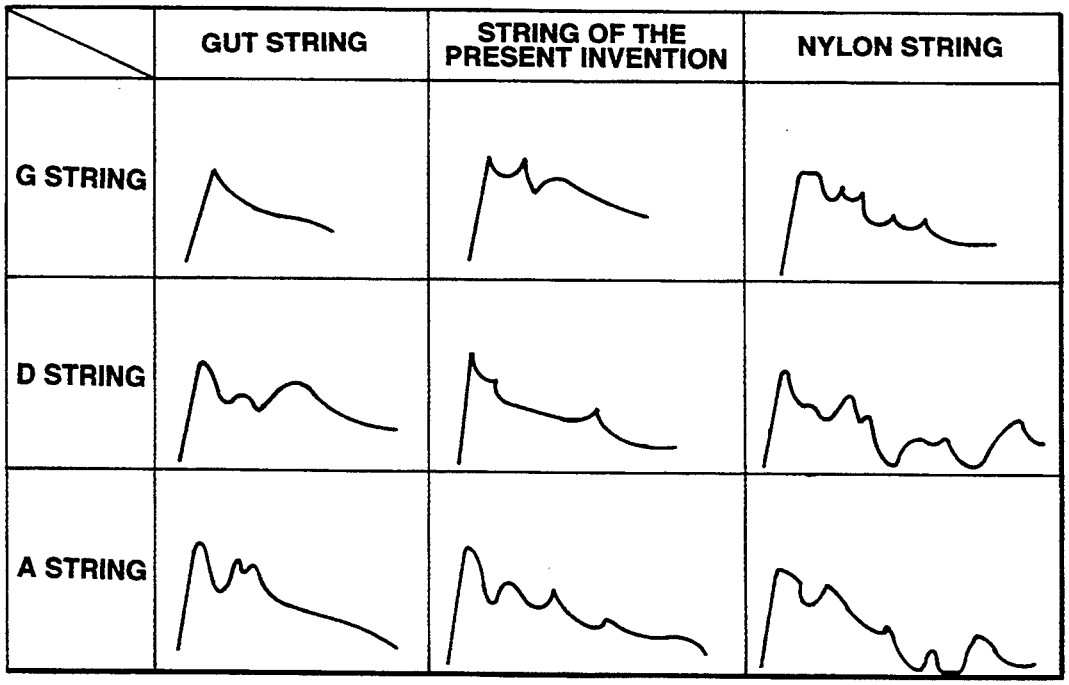
FIG. 1 shows the envelopes of harmonic tones.

The material used as a core material of a string for instrument according to the present invention will be explained. A vinylidene fluoride resin used in the present invention is a vinylidene fluoride homopolymer and a copolymer of vinylidene fluoride and another monomer which is copolymerizable with vinylidene fluoride. Examples of other monomers are fluorine-containing olefins such as vinyl fluoride, ethylene chloride trifluoride, ethylene tetrafluoride and propylene hexafluoride. The content of vinylidene fluoride in a vinylidene fluoride copolymer is not less than 70 mol %, preferably not less than 80 mol %.

A vinylidene fluoride resin is usable not only singly but also as a mixture with a nucleating agent such as polyester plasticizers, phthalic acid plasticizers and flavanthrone, or a resin such as polymethylmethacrylate and polyethylacrylate which has a good compatibility with a vinylidene fluoride resin.

A monofilament which simultaneously possesses the following properties (1) to (6) is preferably used as a monofilament which constitutes the multifilament used in the present invention:

(1) a diameter of 1 to 300 $\mu$m;
(2) a dispersion of diameters of not more than 20%/m;
(3) a specific gravity of not less than 1.6;
(4) an inherent viscosity of 0.85 to 1.6 dl/g;
(5) an apparent viscosity measured at 240° C. at a shear rate of 1/50 sec, of 12000 to 100000 poise; and
(6) a birefringence of $30\times10^{-3}$ to $50\times10^{-3}$.

The dispersion of diameters is measured in the following manner.

A filament of 1 m long is cut at 10 points and the maximum diameter and the minimum diameter of each point are measured by a light microscope. The diameter (A) of the filament at each point is obtained from the formula:

$$\text{Diameter (A)} = (\text{maximum diameter} + \text{minimum diameter})/2,$$

The average diameter (B) of the filament is obtained from the formula:

$$\text{Average diameter(B)} = (A_1 + A_2 + A_3 + \ldots + A_{10})/10$$

The average of the maximum diameters and the average of the minimum diameters are further obtained from the respective measured values. The dispersion of diameters is then obtained from the formula:

$$\text{Dispersion} = \{(\text{average of maximum diameters}) - (\text{average of minimum diameters})\}/(B) \times 100\ (\%)$$

It is necessary for the production of the required intervals that a string has an appropriate ,diameter. When a multifilament is made of monofilaments each of which has a diameter of 1 to 300 μm and a twist is made of at least two obtained multifilaments, the twist has a diameter required of a string for instruments of the present invention. It is also necessary for the stability of an interval that a string has an appropriate dispersion of diameters. By using a monofilament which satisfies the condition (2), it is possible to produce a core material of a string for instruments of the present invention which can greatly reduce the unevenness and nonuniformity in interval and facilitate tuning. The dispersion of diameters is preferably not more than 10%/m.

The specific gravity (μ) influences the harmonic vibration ($V_K$) Of the core material of a string in accordance with the following formula:

$$v_K = \{K/(2 \times L)\} \times \sqrt{(T/m)}$$

wherein K=1, 2, 3 . . . , L represents the length of the core material, T represents the tension (kg), and m represents a mass per unit length, which is proportional to the specific gravity (μ).

Consequently, the larger the specific gravity (μ), the higher the sound wave velocity and the larger the vibrational energy, so that a sufficient volume is obtained. The specific gravity is preferably 1.7 to 1.8. The specific gravity is a value measured at 20° C. by using a gradient tube filled with zinc chloride and distilled water.

The inherent viscosity (4) and the apparent viscosity (5) are necessary for the production of a core material of a string for instruments of the present invention. If the inherent viscosity is less than 0.85 dl/g, the creep characteristics may be deteriorated so much that it is difficult to produce a core material of a string for instruments which has a satisfactory mechanical strength. On the other hand, if it exceeds 1.6 dl/g, the viscosity becomes so high that it is difficult to produce a core material of a string for instruments. This is the same with the apparent viscosity. The inherent viscosity is preferably in the range of 0.85 to 1.1 dl/g. The apparent viscosity is preferably in the range of 12000 to 33000 poise.

The birefringence of a filament has a relationship with a timbre. As the birefringence is larger, the timbre becomes clearer and the string produces a crystal or metallic sound. If the birefringence is less than $30 \times 10^{-3}$, the sound becomes blurred. On the other hand, if the birefringence exceeds $50 \times 10^{-3}$, the sound becomes so metallic as to makes the impression of a noisy sound. The birefringence is preferably in the range of $35 \times 10^{-3}$ to $50 \times 10^{-3}$, more preferably in the range of $40 \times 10^{-3}$ to $48 \times 10^{-3}$.

In the present invention, it is preferable to use a multifilament which is composed of 5 to 1000, more preferably 12 to 36 monofilaments and which has a fineness of 100 to 500 d. .Although a multifilament is usable as it is, it is preferably to singly twist the multifilament and use as a piled yarn. The direction of twist may be either S twisting or Z twisting, and the number of twists is 0.1 to 10/inch, preferably 0.5 to 3/inch.

A core material of a string for instruments of the present invention is composed of a twist of at least two multifilaments, which simultaneously possesses the following properties (a) to (e):

(a) a diameter of 0.t to 5 mm;
(b) an elongation of 10 to 50%;
(c) a tensile strength of not less than 30 kg/mm$^2$;
(d) a creep elongation of not more than 15% (measured 24 hours after a load under which the stress is 20% of the tensile strength is applied to the twist); and
(e) a Young's modulus of not less than 200 kg/mm$^2$.

The diameter (a) of the core material is necessary for the production of the required intervals as a string for instruments. The optimum diameter of a string for instruments is slightly different depending upon which tone the string is tuned. For example, in the case of a violin string, the optimum diameter of the A string is about 0.65 mm, that of the D string is about 0.68 mm, and that of the G string is about 0.77 mm. The adjustment of the diameter of a string for instruments is conducted by adjusting the thickness and the number of turns of a metal wire in the process of winding the metal wire around a core material, as will be described later. Since a core material of a string for instruments of the present invention has a diameter of 0.1 to 5 mm, as described above, the process of winding a metal wire is facilitated.

The tensile strength and the elongation of the core material show the mechanical strength thereof. The values (b) and (c) are required of a core material which is suitable for a string for instruments. The tensile strength is preferably 50 to 100 kg/mm$^2$, more preferably 75 to 85 kg/mm$^2$. The elongation is preferably in the range of 10 to 30%.

If the creep elongation is more than 15%, when the core material is tightened, it lengthens with the elapse of time and the string therefore becomes out of tune. The creep elongation is preferably in the range of 2 to 6%.

The Young's modulus influences on what is called sound hardness. The larger the Young's modulus is, the sharper and the more crystal the sound becomes. If the Young's modulus is less than 200 kg/mm$^2$, the timbre becomes blurred. The Young's modulus is preferably in the range of 400 to 600 kg/mm. The Young's modulus is obtained from the gradient of the straight line which combines the points of 0.1% and 3% of the elongation measured with the maximum load.

In the present invention, a breaking strength of the twist of multifilaments is preferably 3.5 to 6.0 g/d. The direction of twist may be either S twisting or Z twisting. When a piled yarn is used as a multifilament, the multifilaments are twisted in the reverse direction to the direction of twist of the piled yarn and used as a folded and twisted yarn. The number of twist is 0.1 to 10/inch, preferably 0.5 to 5/inch.

A method of producing a core material of a string for instruments of the present invention will now be explained. A core material of a string for instruments of the present invention is produced by a known method through a multifilament producing step, a stretching step and a twisting step.

In the step of producing a multifilament, a vinylydene fluoride resin is melt-extruded from a nozzle in the form of monofilaments, .which are treated by a converging agent, and the thus-obtained multifilament is taken up. The producing conditions may be selected as occasion demands. For example, the nozzle temperature is 230° to 340° C., preferably 245° to 265° C., the extruder output per hole of the nozzle is 0.005 to 3 g/min., preferably 0.1 to 1 g/min., and the draft ratio is 1000 to 5000. The distance between the nozzle and the converging portion is 0.3 to 3 m, preferably 0.4 to 2 m.

In the step of stretching the multifilament, a stretching apparatus of a Nelson roller system, for example, is usable. Such a stretching apparatus is mainly composed of first to third rollers, two hot plates disposed between every two rollers, and a spindle. The stretch ratio at a first-stage stretch performed between the first and the second rollers is 1 to 5:1, preferably 1.1 to 2.0:1, and the stretch ratio at a second-stage stretch performed between the second and the third rollers is 0.9 to 2:1, preferably 0.95 to 1.2:1. The temperature of the first hot plate disposed between the first and the second rollers is 160° to 180° C., and the temperature of the second hot plate disposed between the second and the third rollers is 130° to 150° C. The take-up rate is 80 to 120 m/min., and the number of revolutions of the spindle is 3000 to 4000 rpm.

In the step of twisting the multifilaments, a twister of a Nelson roller system, for example, may be used. In the twisting step, at least two spindles which have taken up multifilaments are prepared. When a piled yarn is used as a multifilament,, the multifilaments are twisted in the reverse direction to the direction of twist of the piled yarn and used as a folded and twisted yarn. The twist taken up by a spindle is dried with heat, for example, at a temperature of 130° to 150° C. for 0.5 to 2 hours for the purpose of twist setting and the obtained product is used as a core material of a string for instruments of the present invention.

A string for instruments according to the present invention will now be explained.

A string for instruments of the present invention is produced by tightly winding a fine metal wire around the above-described core material. The step of tightly winding the fine metal wire may be executed in the same way as in the production of a conventional string for instruments. For example, as the fine metal wire, a fine flat wire of phosphor bronze is preferably used and the number of turns may be selected as occasion demands. The thickness of the fine metal wire is in the range of 0.05 to 0.1 mm. After the tight winding of the fine metal wire, the surface is machined so that the protruding portions of the fine metal wire are ground and the groove portions formed between the protruding portions are leveled therewith. The string for instruments of the present invention obtained in this way produces an excellent effect, especially, as a violin string. When the A string, the D string and the G string for a violin according to the present invention were set on a violin and evaluated subjectively by a player, the evaluation was equivalent to that of a gut string. A string for instruments of the present invention is favorably usable as a string for a lower-pitched string of a viola, a cello, a contrabass and a guitar (fourth to sixth-strings) as well as a violin.

A string for instruments of the present invention does not require a long time for tuning, and since it is made of a vinylydene fluoride resin, it is free from problems such as that it becomes out of tune due to a change in humidity, or that it is easily broken. In addition, the envelope of harmonic tones resembles that of a gut string, which has an excellent timbre. Furthermore, since the string produces a sound having a large volume and the rise time of a sound is short, it is favorable especially to play a solo, and the sound produced is not greatly influenced by the quality of the instrument or the technical skill of the player.

EXAMPLES

The present invention will be explained in more detail hereinunder with reference to the following examples, but the present invention is not restricted to those examples and various modifications are possible within the scope of the invention.

In the following examples, a melt-extruder provided with a nozzle having a diameter of 2 mm, a thickness of 20 mm and 24 holes was used, and the pellet composed of a vinylidene fluoride homopolymer having an inherent viscosity of 1.0 dl/g and an apparent viscosity measured at a temperature of 240° C. at a shear rate of 1/50 sec was 22000 poise was used.

Example 1

A pellet of a vinylidene fluoride homopolymer was melt-extruded under the conditions that the nozzle temperature was 255° C., the extruder output per one hole of the nozzle was 0.42 g/min. and the draft ratio was about 3500. The extruded product was then passed through a converging portion (an oil solution was used as a converging agent) disposed directly under the nozzle, and taken up at a take-up rate of 260 m/min. through a guide roll. The distance between the nozzle and the converging portion was 1 m. In this space, a heat mantle was disposed at the upper portion and an insulating mantle and a shielding equipment were disposed at a lower portion so as to shield the atmosphere from the outside and to insulate heat, thereby preventing the filaments being disturbed from the outside.

The taken-up multifilament was stretched and single-twisted by a stretching apparatus of a Nelson roller system under the following conditions to obtain a piled yarn.

The stretch ratio of a first-stage stretch performed between a first roller and a second roller: 1.18 times The stretch ratio of a second-stage stretch performed between the second roller and a third roller: 0.99 time The temperature of the first roller: 100° C.

The temperature of a first hot plate disposed between the first roller and the second roller: 170° C.

The temperature of a second hot plate disposed between the second roller and the third roller: 140° C.

The take-up rate: 100 m/min.

The number of revolutions of the spindle: 3500 rpm

The piled yarns (multifilaments) were sampled and the properties thereof were measured. The results are shown in the following. The monofilaments constituting the piled yarn were also sampled and the properties thereof were measured. The results are shown in the following.

Properties of Multifilament

Fineness: 300 d(24 F)

Direction of twist: S twisting

Number of twists: 0.9/inch

Properties of Monofilament

Diameter: 32 μm

Dispersion of diameters: not more than 1.5%/m

Specific gravity: 1.78

Birefringence: $38\times10^{-3}$

Eight of the piled yarns (multifilaments) obtained in this way were set in a twister so as to twist them in the direction of Z twisting at twice per inch. The folded and twisted yarn obtained was then dried with heat at a temperature of 140° C. for 1 hour, thereby obtaining a folded and twisted yarn of eight piled yarns as a core material of a string for instruments of the present invention. The results of the measurement of the properties of the core material are shown in the following.

Diameter: 0.52 mm

Elongation: 13.8%

Tensile strength: 75 kg/mm$^2$

Creep elongation: 3.9%

(measured 24 hours after a load under which the stress is 20% of the tensile strength is applied to the twist)

Young's modulus: 296 kg/mm$^2$

Example 2

A core material composed of a folded and twisted yarn of six piled yarns was produced in the same way as in Example 1 except that six piled yarns (fineness of multifilament: 300 d (24 F)) were set in the twister. The results of the measurement of the properties of the core material are shown in the following.

Diameter: 0.45 mm

Elongation: 13%

Tensile strength: 77.3 kg/mm$^2$

Creep elongation: 3.5%

Young's modulus: 305 kg/mm$^2$

Example 3

A fine flat wire of phosphor bronze was tightly wound around each of the cores material obtained in Examples 1 and 2, respectively, under the conditions shown in the following Table 1.

TABLE 1

| | Core material | Thickness (mm) of phosphor bronze | Number of turns |
|---|---|---|---|
| A string | Ex. 1 (300 d × 8) | 0.05 | 2 |
| D string | Ex. 1 (300 d × 8) | 0.07 | 2 |
| G string | Ex. 2 (300 d × 6) | 0.10 | 2 |

Thereafter, the surfaces of the strings were machined to obtain the strings for instruments according to the present invention which are shown in the following Table 2. The sound produced from each string was analyzed by an FFT analyzer together in comparison with the commercially available gut strings (trade name: Eudoxa) and nylon strings (trade name: Thomastik/Dominant) which are shown in the following Table 2.

TABLE 2

| | Gut string | Invention | Nylon string |
|---|---|---|---|
| <A string> | | | |
| Diameter (mm) of string | 0.68 | 0.65 | 0.68 |
| METSUKE (g/m) of core material | 0.34 | 0.27 | 0.19 |
| METSUKE (g/m) of string | 0.59 | 0.66 | 0.69 |
| <D string> | | | |
| Diameter (mm) of string | 0.83 | 0.68 | 0.81 |
| METSUKE (g/m) of core material | 0.40 | 0.27 | 0.15 |
| METSUKE (g/m) of string | 0.97 | 1.23 | 1.11 |
| <G string> | | | |
| Diameter (mm) of string | 0.80 | 0.77 | 0.79 |
| METSUKE (g/m) of core material | 0.39 | 0.19 | 0.20 |
| METSUKE (g/m) of string | 2.41 | 2.92 | 2.76 |

Each string was set on the same violin, and after tuning, a sound was produced on an open string with a bow (without pressing the string against the fingerboard with a finger). The fundamental tone of the A string was 440 Hz, that of the D string was 294 Hz and that of the G string was 196 Hz. A microphone was disposed at a distance of 1.5 m from the violin and a recorder (DAT, manufactured by Sony Corporation) was connected to the microphone to record the sounds. The frequencies and the like of the recorded sounds were analyzed by an FFT analyzer (CF-350, manufactured by Oho Sokki K.K.). The results were as follows.

(1) Harmonic Tones

When the gut strings were used, fewer harmonic tones were produced on each of the A string, the D string and the G string than when the strings of the present invention were used. In addition, frequencies which were supposed to belong to noise were produced in the vicinity of 1.5 to 3.0 KHz. In contrast, when the strings of the present invention were used, more harmonic tones were produced on each string, and since the frequencies which were supposed to belong to noise were few, each string produced a clear sound. On the other hand, when the nylon strings were used, many frequencies which were supposed to belong to noise were produce:d, especially, on the G string. On the whole, the nylon strings produced higher harmonic tones than the gut strings, but there was a part on the A string at which no harmonic tone was produced. As a result, a blurred or impure :Bound was produced.

(2) Envelope of Harmonic Tones (see FIG. 1)

In the case of the gut strings, the curve of the G string falls as the harmonic tone becomes higher. There are in the envelopes of the A string and D string, but the curves gently fall on the higher harmonic tone side. The strings of the present invention resemble the gut strings as shown by the envelopes in FIG. 1. In contrast, in the case of the nylon strings, there are may swells on the envelope of each string, wherein the envelopes of the nylon strings are completely different from those of the gut strings. The sounds produced from the nylon strings sounds impure due to the swells (large amplitude).

(3) Intensity of Harmonic Tones (volume)

The string of the present invention produced a sound having the largest volume, the nylon string a sound having the second largest volume, and the gut string the sound having the smallest volume. That is, the string of the present invention is characterized in the production of a sound having a large volume.

(4) Rise of Sound and Oscillation Period

The oscillation period Of the string of the present invention was slightly shorter and the time required for displaying the full power of the string of the present invention was shorter than those of the gut string. On the other hand, in the case of the nylon strings, the oscillation periods of the A string and the G strings were longer than the oscillation period of the D string. Since the difference in oscillation period between strings was so large that the sounds produced from the nylon strings were ill-balanced. In addition, since the oscillation period was long, the sounds produced from the nylon strings were lacking in delicacy.

What is claimed is:

1. A core material of a string for instruments comprising a twist of at least two multifilaments composed of a vinylidene fluoride resin, wherein the core material simultaneously possesses the following properties (a) to (e):

(a) a diameter of 0.1 to 5 mm;

(b) an elongation of 10 to 50%;

(c) a tensile strength of not less than 30 kg/mm$^2$;

(d) a creep elongation of not more than 15% (measured 24 hours after a load under which the stress is 20% of the tensile strength is applied to the twist); and (e) a Young's modulus of not less than 200 kg/mm$^2$, and wherein the monofilaments which constitute each of said multifilaments simultaneously possess the following properties (1) to (6):

(1) a diameter of 1 to 300 μm;

(2) a dispersion of diameters of not more than 20%/m;

(3) a specific gravity of not less than 1.6;

(4) an inherent viscosity of 0.85 to 1.6 dl/g;

(5) an apparent viscosity measured at 240° C. at a shear rate of 1/50 sec, of 12,000 to 100,000 poise; and (6) a birefringence of $30\times10^{-3}$ to $50\times10^{-3}$.

2. A core material of a string for instruments according to claim 1, wherein the elongation is 10 to 30%, the tensile strength is 50 to 100 kg/mm$^2$, the creep elongation is 2 to 6% and the Young's modulus is 400 to 600 kg/mm$^2$.

3. A core material of a string for instruments according to claim 1, wherein said twist of multifilaments has a breaking strength of 3.5 to 6.0 g/d.

4. A core material of a string for instruments according to claim 1, wherein the number of twists; of said multifilaments is 0.1 to 10/inch.

5. A core material of a string for instruments according to claim 1, wherein said multifilament is composed of 5 to 1000 monofilaments and said multifilament has a fineness of 100 to 500 d.

6. A core material of a string for instruments according to claim 1, wherein said vinylidene fluoride resin is either of a vinylidene fluoride homopolymer or a vinylidene fluoride copolymer containing at least 70 mol % of vinylidene fluoride units.

7. A string for instruments comprising the core material as defined in claim 1 and a metal wire tightly wound around said core material.

8. A string for instruments according to claim 7, wherein said string is a string of either of a violin, a guitar, a viola, a cello or a contrabass.

* * * * *

UNITED STATES PATENT AND TRADEMARK OFFICE

CERTIFICATE OF CORRECTION

PATENT NO. : 5,427,008
DATED : June 27, 1995
INVENTOR(S) : UEBA et al

It is certified that error appears in the above-indentified patent and that said Letters Patent is hereby corrected as shown below:

Cover Sheet, Item [73] insert the second assignee as follows:

--Kureha Gosen Kabushiki Kaisha, Tochigi, Japan--.

Signed and Sealed this

Seventh Day of May, 1996

*Attest:*

Bruce Lehman

BRUCE LEHMAN

*Attesting Officer*

*Commissioner of Patents and Trademarks*